US012677940B2

(12) United States Patent
Farjamrad

(10) Patent No.: US 12,677,940 B2
(45) **Date of Patent: *Jul. 14, 2026**

(54) METHOD FOR CONVERTING CABINETS INTO WHEELCHAIR ACCESSIBLE SPACES WITH RETRACTABLE SHELVING SYSTEM

(71) Applicant: PRIME TECH CABINETS, INC., Santa Ana, CA (US)

(72) Inventor: Bobby Farjamrad, Santa Ana, CA (US)

(73) Assignee: PRIME TECH CABINETS, INC., Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/586,264

(22) Filed: Feb. 23, 2024

(65) Prior Publication Data

US 2024/0197072 A1 Jun. 20, 2024

Related U.S. Application Data

(63) Continuation of application No. 17/351,141, filed on Jun. 17, 2021, now Pat. No. 11,930,921, which is a (Continued)

(51) Int. Cl.
*A47B 43/00* (2006.01)
*A47B 1/06* (2006.01)
(Continued)

(52) U.S. Cl.
CPC ..... *A47B 43/00* (2013.01); *A47B 77/06* (2013.01); *A47B 96/021* (2013.01); (Continued)

(58) Field of Classification Search
CPC ..... A47B 43/00; A47B 46/00; A47B 77/06; A47B 77/10; A47B 96/025; A47B 96/021; A47B 2220/03
See application file for complete search history.

(56) References Cited

U.S. PATENT DOCUMENTS 4,263 A 11/1845 Moore
2,808,305 A 10/1957 Jackson
(Continued)

FOREIGN PATENT DOCUMENTS

DE 19505392 A1 8/1996
FR 1536997 A 8/1968
(Continued)

*Primary Examiner* — Kimberley S Wright
(74) *Attorney, Agent, or Firm* — Jafari Law Group, Inc.

(57) ABSTRACT

The invention involves a method for converting a cabinet into a wheelchair accessible space, involving a retractable shelf with anterior, intermediate, and posterior panels. The method includes detaching the anterior panel from the cabinet's support component by removing a screw, folding the anterior panel towards the cabinet's posterior, and laying it parallel on the intermediate panel. Subsequently, the intermediate panel is folded onto the posterior panel, with the anterior panel stacked on top, revealing a wheelchair accessible area. The retractable shelf, initially in an expanded position, features hinged connections allowing parallel folding of the panels. The method is designed for universal installation within the cabinet, obviating the need for complete de-installation or re-installation.

20 Claims, 15 Drawing Sheets

Related U.S. Application Data continuation of application No. 17/011,922, filed on Sep. 3, 2020, now Pat. No. 11,064,802.

(60) Provisional application No. 62/895,648, filed on Sep. 4, 2019.

(51) Int. Cl.

| | |
|---|---|
| ***A47B 46/00*** | (2006.01) |
| ***A47B 77/06*** | (2006.01) |
| ***A47B 96/02*** | (2006.01) |
| *A47B 77/10* | (2006.01) |

(52) U.S. Cl.

CPC ..... *A47B 96/025* (2013.01); *A47B 46/00* (2013.01); *A47B 77/10* (2013.01); *A47B 2220/03* (2013.01)

(56) References Cited

U.S. PATENT DOCUMENTS

| | | | | |
|---|---|---|---|---|
| 3,048,461 | A | 8/1962 | Peterson | |
| 3,458,242 | A | 7/1969 | Williams | |
| 3,612,288 | A | 10/1971 | Lesley | |
| 3,975,069 | A | 8/1976 | DeLucia | |
| 4,249,785 | A | 2/1981 | Hapgood | |
| 4,263,854 | A | 4/1981 | Moore | |
| 4,799,743 | A | 1/1989 | Kikuchi | |
| 4,846,304 | A | 7/1989 | Rasmussen | |
| 5,662,396 | A | 9/1997 | Reeder | |
| 5,664,852 | A | 9/1997 | Robinson | |
| 5,983,808 | A * | 11/1999 | Weil | A47B 77/022 211/90.01 |
| 7,096,797 | B2 | 8/2006 | Sharpe | |
| 7,836,832 | B2 | 11/2010 | Boyd | |
| 8,407,946 | B1 * | 4/2013 | Aaron | A47B 43/00 52/36.2 |
| 8,584,872 | B2 | 11/2013 | Eisman | |
| D741,095 | S | 10/2015 | Leduc | |
| 9,585,471 | B2 | 3/2017 | Beauregard et al. | |
| 9,770,097 | B2 | 9/2017 | Ehrreich et al. | |
| 10,278,502 | B2 | 5/2019 | Farahani | |
| 11,064,802 | B2 * | 7/2021 | Farjamrad | A47B 77/06 |
| 11,930,921 | B2 * | 3/2024 | Farjamrad | A47B 77/06 |
| 2005/0252422 | A1 | 11/2005 | Sharpe | |
| 2012/0080393 | A1 | 4/2012 | Eisman | |
| 2015/0296981 | A1 | 10/2015 | Beauregard et al. | |
| 2018/0177298 | A1 | 6/2018 | Farahani | |
| 2021/0059404 | A1 * | 3/2021 | Farjamrad | A47B 43/00 |
| 2021/0307507 | A1 * | 10/2021 | Farjamrad | A47B 96/025 |

FOREIGN PATENT DOCUMENTS

| | | | |
|---|---|---|---|
| FR | 2788203 | A1 | 7/2000 |
| FR | 2817454 | A1 | 6/2002 |
| FR | 2846536 | A1 | 5/2004 |
| JP | H0572230 | U | 10/1993 |
| JP | H11271 | A | 1/1999 |

* cited by examiner

METHOD FOR CONVERTING CABINETS INTO WHEELCHAIR ACCESSIBLE SPACES WITH RETRACTABLE SHELVING SYSTEM

PRIORITY TO RELATED APPLICATION

This Non-Provisional Application is a Continuation Application of U.S. Non-provisional patent application with Ser. No. 17/351,141, filed Jun. 17, 2021, which is a Continuation Application of U.S. Non-provisional Patent Application with Ser. No. 17/011,922, filed Sep. 3, 2020, which claims priority to U.S. Provisional Application No. 62/895,648, filed on Sep. 4, 2019, the disclosure of each incorporated by reference in their entirety.

TECHNICAL FIELD OF THE INVENTION

The present invention relates generally to a system and method for retrofitting cabinets with a retractable shelf to accommodate accessibility guidelines. More specifically, the present invention relates to a system and method that employs a retractable shelf configured to expand and retract for concealing and revealing a space suitable for wheelchair accessibility.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

The Americans with Disabilities Act (ADA) imposes particular requirements for buildings to be accessible to and accommodate users with disabilities or limited mobility. Fixtures within buildings, therefore, must meet minimum standards of height, clearance, and depth, as prescribed by the ADA, such that fixtures, furniture, and other building components may be accessible to wheelchair users. In making such fixtures accessible, e.g. sinks, bathtubs, showers, and the like, these fixtures may be designed in such a way that they may be adjustable. For example, a shower may be designed such that its height is adjustable. As yet another example, a safety rail may be designed such that it is not fixed but can be moved to various positions to accommodate the heights of various users.

Typically, newly constructed public buildings, and private buildings providing rented living spaces, are required to meet ADA accessibility guidelines. Buildings and facilities often choose to install accessible fixtures that even exceed ADA requirements. One such fixture that requires modification for accessibility is the bathroom and/or kitchen sink, which typically requires an adjustment to accommodate a wheelchair, so as to cater to disabled, weakened, or mobility-impaired users. Wheelchair-accessible sinks are particularly needed, such as for elderly persons seeking to continue residing in their own homes as they age. Wheelchair sinks installed in the home can generally be customized to meet the specific needs of individual users. Wheelchair accessible sinks are also widely used in facilities accommodating a volume of disabled and weakened persons, such as hospitals and assisted living facilities. Such places often require sinks to have adjustable features and minimum requirements, so as to accommodate multiple users having different needs.

For example, the ADA requires that sink tops be mounted no higher than 34 inches from the floor. Additionally, the ADA requires that there be a space below the sink of at least 29 inches high, 30 inches wide, and 25 inches deep to accommodate knee room. The ADA also requires that there be a cleared space of 30 inches by 48 inches around the sink, wherein the sink cabinet door may not open into this space. The ADA also requires that wheelchair accessible washbasins be no deeper than 6.5 inches, and that faucets be turned on and off via a lever, touch, push, or motion sensor, and be operable with only one hand, wherein users do not have to squeeze, grasp, twist, or exert more than five pounds of pressure.

There are a variety of ADA-compliant wheelchair sinks designed to accommodate various needs. For example, ADA wall-mounted sinks are sturdy, basic washbasins that can be mounted directly to a wall according to ADA measurement guidelines. Such wall-mounted sinks are most useful in bathrooms or kitchens that accommodate a smaller number of disabled users. Height-adjustable sinks are typically mounted to a track that is attached to the wall, and often can move laterally as well as vertically. ADA compliant under-mount sinks also may be chosen; such sinks are designed to be installed in a cabinet, counter, or other supportive structure. Such under-mount sinks are often installed in places where space and storage are desirable. Although ADA-compliant under-mount washbasins and faucets are readily available and commonplace, additional care still must be taken to assure that the spaces they are mounted in also meet ADA clearance requirements, because cabinets typically inhibit knee room for wheelchair users. Wheelchair sinks, therefore, can make routine tasks safer and more comfortable for disabled, weakened, or mobility impaired individuals.

Typically, for an under-mount sink installed in a cabinet, or other supportive structure, much work is required to transform the under-mount sink into an ADA-compliant, wheelchair sink. For example, the floor or bottom shelf of such a cabinet typically must be entirely removed, which requires initial removal of the doors of the cabinet, and then the manual task of dismantling the bolts and screws of the bottom shelf of the cabinet to remove the bottom shelf. After the bottom shelf has been removed, the floor below the cabinet typically must be "finished" or re-surfaced, which also may be costly and labor-intensive, and which typically cannot be accomplished without first dismantling at least a portion of the overlying cabinet. Much effort then must also be expended to replace the bottom shelf of the under-mount sink cabinet, to accommodate a new tenant that does not require wheelchair accessibility.

Therefore, there exists a previously unappreciated need for a cabinet that is always ADA-compliant, in that the bottom shelf of the cabinet can be easily removed, retracted, or adjusted, by folding, sliding, or otherwise retracting the bottom shelf of the cabinet, such that a space below the cabinet is easily transformed into a wheelchair accessible space. There also exists a previously unappreciated need for the same bottom shelf to be easily replaced, by unfolding, sliding, or otherwise extending back into place, so that the same wheelchair accessible space becomes suitable for non-wheelchair use. It is to these ends that the present invention has been developed.

SUMMARY OF THE INVENTION

To minimize the limitations in the prior art, and to minimize other limitations that will be apparent upon reading and understanding the present specification, the present invention describes a system and method that employs a retractable shelf configured to expand and retract for concealing and revealing a space suitable for wheelchair accessibility. As will be described below, the retractable shelf may be employed in a manner so that the cabinet is retrofitted to meet accessibility guidelines such as wheelchair accessibility.

A method for converting a cabinet into a wheelchair accessible space is disclosed herein. The method comprises the steps of providing a cabinet with a retractable shelf that includes a plurality of panels such as an anterior panel, an intermediate panel, and a posterior panel; removing a coupling component that secures the anterior panel of the retractable shelf to a support component of the cabinet; lifting and folding the anterior panel towards the posterior of the cabinet cavity; folding the intermediate panel onto the top surface of the posterior panel within the cabinet; stacking the anterior panel on top of the intermediate panel; and revealing a wheelchair accessible area within the cabinet by the stacking of the panels.

In an embodiment, the retractable shelf is initially in an expanded position.

In an embodiment, the coupling component comprises a screw.

In an embodiment, the anterior panel is hingedly connected to the intermediate panel.

In an embodiment, the intermediate panel is hingedly connected to the posterior panel.

In an embodiment, the folding of the anterior panel onto the intermediate panel is such that the anterior panel lays parallel and on top of the intermediate panel.

In an embodiment, the folding of the intermediate panel onto the posterior panel is such that the intermediate panel lays parallel and on top of the posterior panel.

In an embodiment, the retractable shelf is configured to be universally installed within the cabinet.

In an embodiment, the method does not require a complete de-installation and re-installation of the cabinet to meet accessibility requirements.

In an embodiment, the method facilitates conversion of the cabinet into a wheelchair accessible space without extensive labor.

The present disclosure further envisages a method for manipulating a retractable shelf within a cabinet to create a wheelchair accessible space. The method comprises providing a cabinet with a retractable shelf that includes three hingedly connected panels such as an anterior panel, an intermediate panel, and a posterior panel; detaching the anterior panel from a support component of the cabinet by removing a screw; folding the anterior panel towards the posterior of the cabinet cavity and laying it parallel on top of an intermediate panel; lifting the anterior panel and flipping the intermediate panel onto the top surface of a posterior panel; folding the anterior panel over the intermediate panel to form a compact stack; revealing a wheelchair accessible space by the compact stacking of the panels; and maintaining the posterior panel secured to the cabinet throughout the method.

In an embodiment, the retractable shelf is initially in an expanded position prior to manipulation.

In an embodiment, the hinged connection between the anterior and intermediate panels is configured to allow parallel folding In an embodiment, the hinged connection between the intermediate and posterior panels is configured to allow parallel folding.

In an embodiment, the retractable shelf is adapted to remain in a partially folded position to reveal an appropriate wheelchair accessible space.

In an embodiment, the retractable shelf is further folded or retracted to reveal the wheelchair accessible space when the partially folded position is insufficient.

In an embodiment, the retractable shelf comprises hidden barrel hinges for folding the panels.

In an embodiment, the hidden barrel hinges are partially inserted into apertures drilled into the panels.

In an embodiment, the hidden barrel hinges comprise two barrel-like components configured to pivot about an axis.

In an embodiment, the retractable shelf is configured to be manipulated without the need for labor-intensive removal or alteration of the cabinet structure.

Various objectives and advantages of the present invention will become apparent from the following description taken in conjunction with the accompanying drawings wherein are set forth, by way of illustration and example, certain embodiments of this invention. The drawings submitted herein constitute a part of this specification, include exemplary embodiments of the present invention, and illustrate various objects and features thereof.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows.

DETAILED DESCRIPTION OF THE INVENTION

Figure 1A:
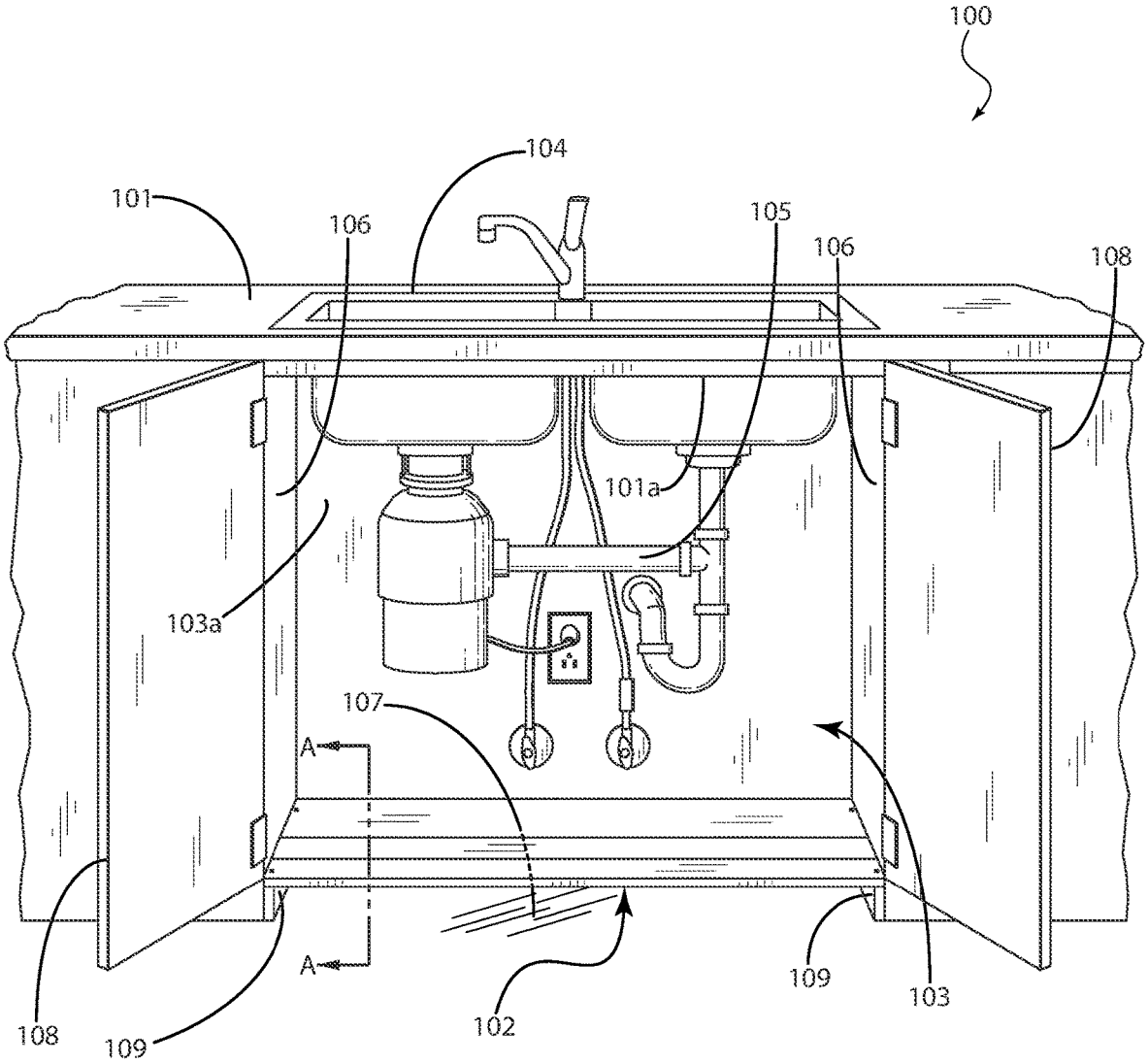
FIG. 1A illustrates a cabinet system configured with a retractable shelf for accommodating wheelchair accessibility, in accordance with an exemplary embodiment of the present invention, the system shown in an expanded position for concealing a wheelchair accessible space.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Turning now to the figures, FIG. 1A illustrates a cabinet system configured with a retractable shelf for accommodating wheelchair accessibility, in accordance with an exemplary embodiment of the present invention, the system shown in an expanded position for concealing a wheelchair accessible space within a portion of a cavity of the cabinet. More specifically, FIG. 1A depicts system 100, which is a cabinet system including a cabinet 101 with a retractable shelf 102 that is configured to retract and expand in order to, respectively, reveal and conceal a wheelchair accessible space within a portion of a cavity 103 of cabinet 101. In this view of FIG. 1A, retractable shelf 102 is in an expanded configuration. In some exemplary embodiments, cabinet 102 may be a cabinet that includes a sink 104, such as a kitchen sink. Of course, in other exemplary embodiments, cabinet 102 does not include a sink and may be any other type of cabinet for which wheel accessibility may be desirably facilitated.

In the shown exemplary embodiment, sink 104 is a kitchen sink and thus may be coupled to plumbing components 105 typical of kitchen sinks and generally situated below the sink and within cavity 103 of cabinet 102. As may be appreciated by those skilled in the art, cavity 103 is generally formed within a perimeter of panels and a surface on which the cabinet is installed, such as a floor area. In the shown exemplary embodiment, cavity 103 is formed by an upper panel 101*a*, side panels 106, and surface area 107 on top of which cabinet 101 is installed. In some exemplary embodiments, cabinet 101 may include doors 108, but in other exemplary embodiments, doors 108 may be removed or not installed at all, depending on the desired configuration of cabinet 101.

Typically, retractable shelf 102 is installed in proximity to the floor or surface area 107 that is underneath upper surface 101*a* of cabinet 101. Installing retractable shelf 102 may be achieved in a number of ways without deviating from the scope of the present invention, including but not limited to coupling at least a portion of retractable shelf 102 to a portion of or component of cabinet 101. For example, in the shown embodiment, retractable shelf 102 is partially coupled to support members 109 which run parallel and adjacent to each of side panels 106, and perpendicular to the bottom terminal region of rear panel 103*a* (or a nailer portion thereof) of cabinet 101. In exemplary embodiments, such as the one shown in FIG. 1A and FIG. 1B, support members 109 and the bottom or nailer portion of rear panel 103*a* form a perimeter of the surface area 107. Moreover, each of support members 109 provide a support surface, as will be better appreciated from additional views discussed below, on which retractable shelf 102 may be secured to. In other exemplary embodiments, other means may be used to install retractable shelf 102, including for example coupling portions of retractable shelf 102 to the side panels or nailer portion of rear panel 103*a*. However, support members offer a desirable support that makes installation of retractable shelf 102 easy and cost effective.

As may be appreciated from this view, when in the expanded configuration, retractable shelf 102 completely covers or conceals the surface area 107 within cavity 103. When selectively exposed, surface area 107 or a portion thereof, may be utilized as a wheelchair accessible space. As such, wheelchair accessible space 110 becomes accessible when the retractable shelf 102 is retracted as shown in the next figure. In some exemplary embodiments, the retractable shelf may retract by sliding into an indentation within the flooring beneath the cabinet, or by folding into an indentation within the flooring beneath the cabinet. In some exemplary embodiments, the retractable shelf may retract by sliding into an adjacent portion of the cabinet, or by folding into an adjacent portion of the cabinet. In some exemplary embodiments, the retractable shelf may be retracted or expanded by a push and/or lift of the user's foot, such that the user does not have to bend and/or use one's hands to retract or expand the shelf. In some exemplary embodiments, the retractable shelf may be retracted or expanded without the doors of the cabinet first having to be removed. In some exemplary embodiments, the retractable shelf may be retracted or expanded simply by folding the shelf into itself, as will de discussed below with reference to other figures.

Figure 1B:
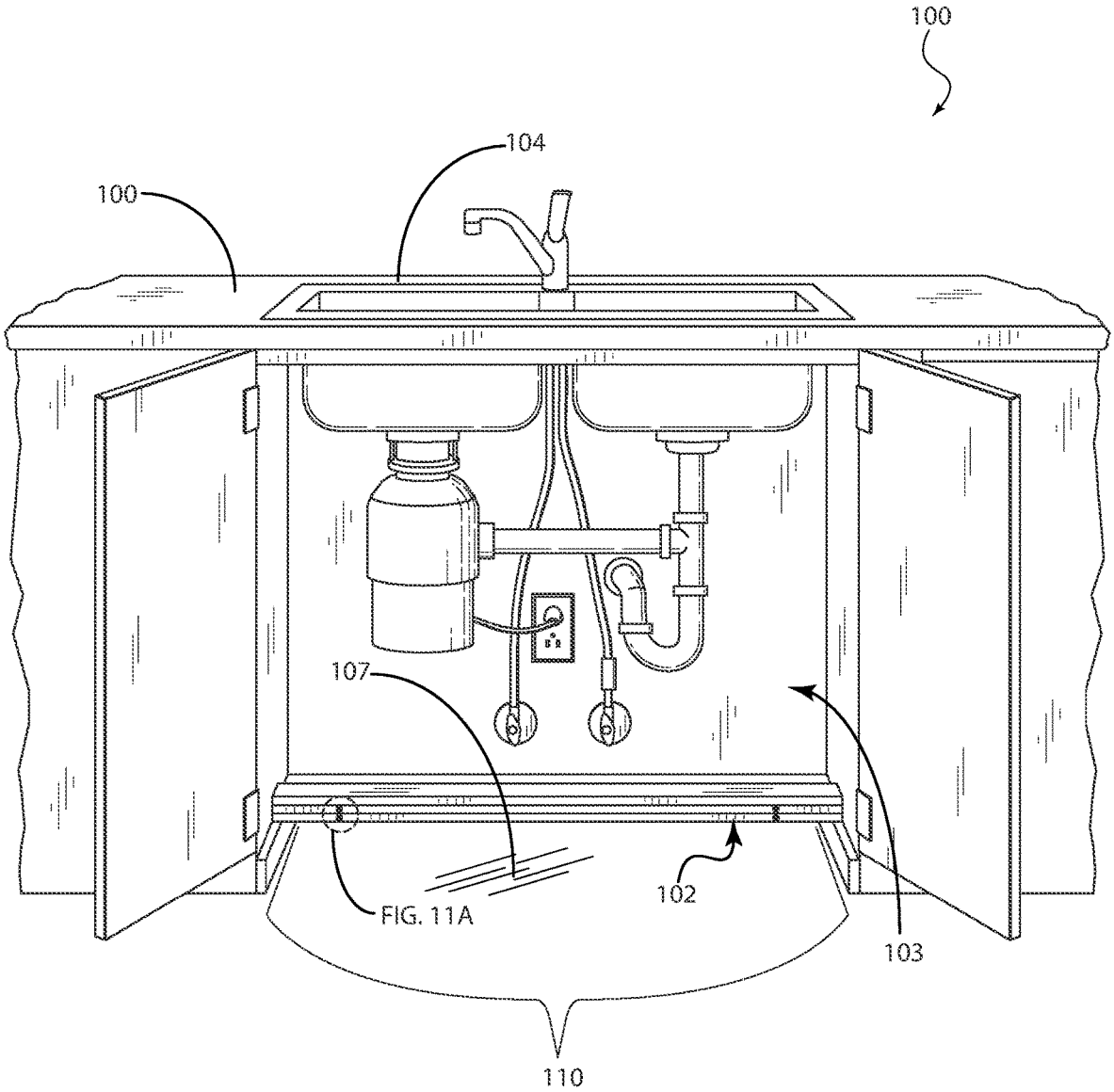
FIG. 1B illustrates a cabinet system configured with a retractable shelf for accommodating wheelchair accessibility, in accordance with an exemplary embodiment of the present invention, the system shown in a retracted position for revealing a wheelchair accessible space.

FIG. 1B illustrates cabinet system 100 with retractable shelf 102 in a retracted position for revealing or providing access to wheelchair accessible space 110. In this exemplary embodiment of FIG. 1A-FIG. 1B, cabinet system 100, configured to accommodate wheelchair accessibility, comprises cabinet 101, which includes a right panel 106, a left panel 106, an upper panel 101*a*, and a rear panel 103*a* that define a cavity 102 and an outer perimeter of the cabinet; and a retractable shelf parallel to the upper panel, situated between the left panel and the right panel and in proximity to a terminal end of the cavity of the cabinet, including: a plurality of panels hingedly coupled together, wherein the plurality of panels comprise: a posterior panel coupled to a portion of the cabinet; and an anterior panel having a perpendicular slat attached to a bottom surface of the anterior panel; wherein the plurality of panels are configured to fold, such that at least one of the plurality of panels folds on top of the posterior panel, and the anterior panel folds perpendicular to the posterior panel to reveal or conceal a space for wheelchair accessibility within the cavity of the cabinet.

Accordingly, in such exemplary embodiments, a cabinet configured to accommodate wheelchair accessibility, may comprise: side panels 106, an upper panel 101*a*, a rear panel 103*a*, and a surface area 107 between the side panels 106 that define a cavity 103 of the cabinet 102; and a retractable shelf 102 parallel to the upper panel 101*a*, situated between the left panel and the right panel 106 and in proximity to the surface area 107 cavity of the cabinet; wherein the retractable shelf is configured to retract or expand to, respectively reveal or conceal a wheelchair accessible space 110 of surface area 107 within a portion of the cavity 103 of the cabinet 102.

Figure 2:
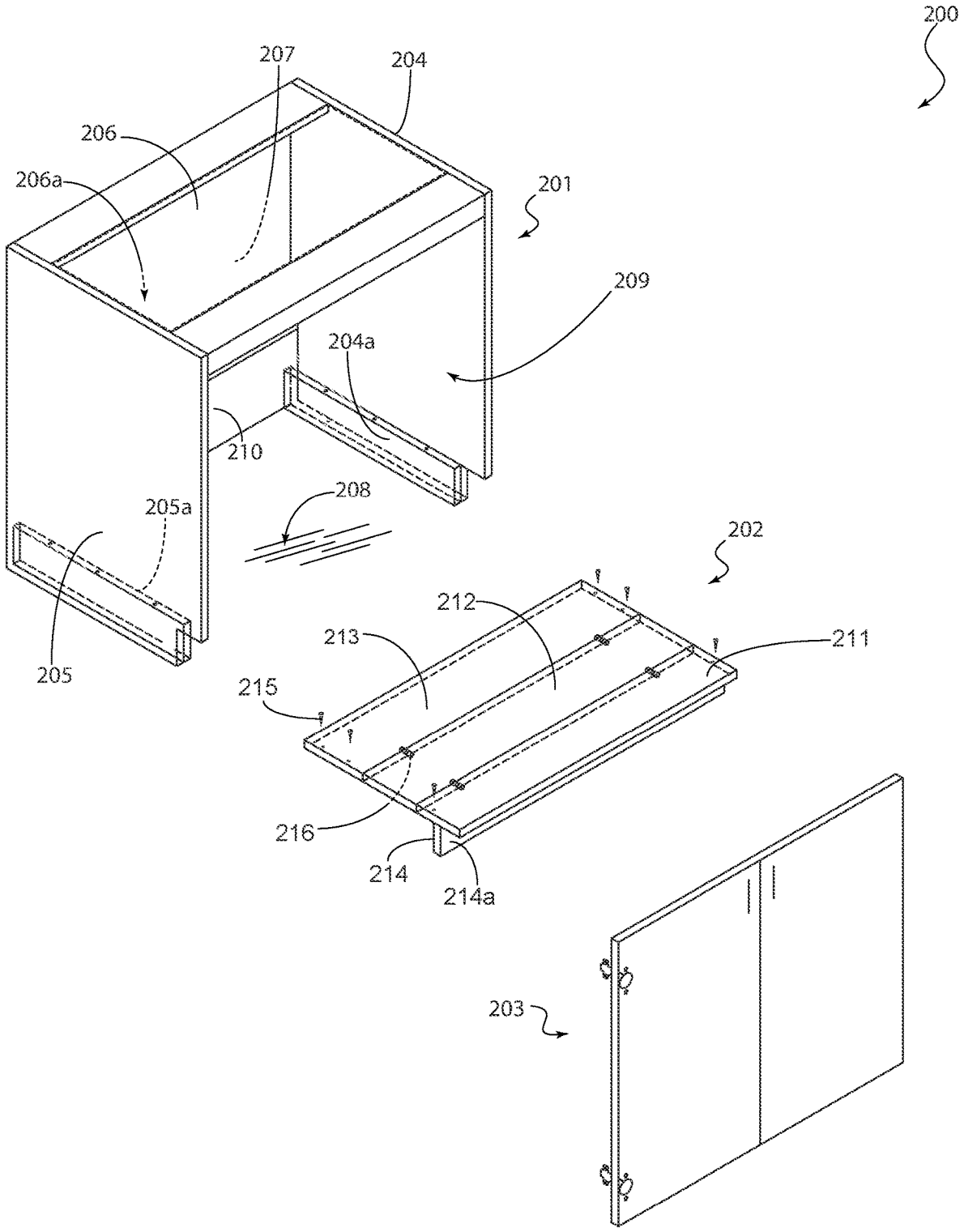
FIG. 2 illustrates an exploded view of a cabinet system including a retractable shelf and corresponding components, in accordance with some exemplary embodiments of the present invention.

Turning now to the next figure, FIG. 2 illustrates an exploded view of a cabinet system including a retractable shelf and corresponding components, in accordance with some exemplary embodiments of the present invention. More specifically, FIG. 2 illustrates an exploded view of cabinet system 200 including a cabinet 201 that has been retrofitted with a retractable shelf 202 and corresponding components (including some optional components such as cabinet doors 203) in order to accommodate accessibility guidelines such as wheelchair accessibility.

Cabinet 201 may be constructed of any type of materials suitable for constructing cabinets, including but not limited to any type of wood, hardwood, plywood, particleboard, fiberboard, and any other type of materials that have the desired strength and durability suitable for the functions of cabinets as they are commonly used in the field. Cabinet 201 may be any type of cabinet that can include or exclude a sink. In exemplary embodiments, cabinet 201 comprises a left panel 204, a right panel 205, a top panel 206, and a rear panel 207, which when installed on a floor or surface area 208, define a cavity 209 of the cabinet 201. In the embodiment of FIG. 2, for illustrative purposes and without limiting the scope of the present invention, cabinet 201 is depicted with an aperture 206*a* along the top panel 206 in order for allowing installment of a sink. In the interior side of each of the left and right panels 204 and 205, and adjacent to each of these side panels, base boards or support members 204*a* and 205*a* may be situated, coupled to, and or attached along a bottom terminal edge of each of the left panel 204 and right panel 205 so that each corresponding support member 204*a* and 205*a* runs perpendicular to rear panel 207. In exemplary embodiments, rear panel 207 may include a support structure such as a board or nailer 210. Support members 204*a* and 205*a* may further be secured to nailer 210 as well as the interior of side panels 204 and 205, respectively. Support members 204*a* and 205 a provide support for securing retractable shelf 202 to a portion thereof. When fully extended, retractable shelf 202 covers or conceals the floor surface 208 that forms the bottom of cavity 209 of the cabinet 201. Floor surface 208 may be any surface area such as cement, wood, or any other type of flooring or surface, whether treated, finished, or unfinished, that may be used as a surface on which cabinet 201 is installed.

Retractable shelf 202 may be constructed of the same or different materials as cabinet 201. For example, and without limiting the scope of the present invention, retractable shelf 202 may be constructed of any type of wood, hardwood, plywood, particleboard, fiberboard, and any other type of material or combination of materials that have the desired strength and durability for a bottom shelf of a cabinet. As such, retractable shelf should be durable enough to allow for storing items and placing items commonly stored within a cabinet. Typically, retractable shelf 202 comprises a plurality of panels 211, 212, and 213, which are hingedly coupled together.

In exemplary embodiment, the plurality of panels include at least one posterior panel 213 coupled to a portion of the cabinet 201, and an anterior panel 211 detached from the cabinet 201. The plurality of panels 211, 212, and 213 are generally configured to reveal or conceal a wheelchair accessible space of the floor surface 208. In exemplary embodiments, the plurality of panels 211, 212, and 213 are more specifically configured to fold, such that at least one of the plurality of panels folds on top of the posterior panel 213 in order to reveal or conceal a wheelchair accessible space of the floor surface 208, including above floor surface 208 within the cavity 209 of the cabinet 201. In some exemplary embodiments, the plurality of panels 211, 212, and 213 are more specifically configured to fold, such that at least one of the plurality of panels (panel 212, for example) folds on top of the posterior panel 213, and the anterior panel 211 folds on top of panel 212 so that it is at least perpendicular to the posterior panel 213.

In some exemplary embodiments, retractable shelf 202 further includes a toe kick. For example, and without limiting the scope of the present invention, the anterior panel 211 may include a perpendicular slat 214 attached to a bottom surface of the anterior panel 211 forming a toe kick of the cabinet 201. As may be appreciated from this and other views discussed in more detail below, when the retractable shelf 202 is in an expanded position, slat 214 will be in contact with the ground so that an anterior face 214*a* of the slat 214 will be facing the front of cabinet 201 and serve as a toe kick for cabinet 201.

In exemplary embodiments, the retractable shelf 202 may fold or otherwise retract to allow for wheelchair accessibility, and may unfold or otherwise extend back into its original position. The retractable shelf 202 will form the bottom floor of a cabinet 201, which cabinet 201 may serve to house a sink. The cabinet 201, in exemplary embodiments having an under-mounted sink within it, may be placed in a kitchen, bathroom, or any location in which a wheelchair-accessible sink is desired. The cabinet 201, in exemplary embodiments, may be placed in any location in which a wheelchair-accessible cabinet, table, or other such wheelchair-accessible surface or structure is desired.

In exemplary embodiments, each pair of panels of the plurality of panels, such as panels 211 and 212, and 212 and 213, of the retractable shelf 202, are hingely coupled to each other by one or more hinges 216, wherein the hinges allow for the panels to fold and/or pivot about the hinges 216, without the panels being detached from each other. In this manner, the retractable shelf 202 in its entirety can be folded and contracted or retracted so as to reveal surface area 208 within cavity 209 of cabinet 201. The hinged coupling of the panels, e.g. 211 and 212, allows the retractable shelf 202 of the cabinet 201 to be contracted and folded, to allow for wheelchair accessibility beneath the cabinet 201, thereby allowing a wheelchair user to more easily access use of a sink or surface area situated on the top of the cabinet 201. Additionally, the coupling of the panels, e.g. 211 and 212, of the retractable shelf 202 will allow for easy unfolding of the shelf 102, thereby restoring the retractable shelf 202 to its original position, when wheelchair accessibility is no longer desired. In exemplary embodiments, the retractable shelf 202 can be folded and unfolded by opening the cabinet doors 103, but without having to first remove cabinet doors 203 from the cabinet 201, unlike typical cabinet structures which generally require disassembly before the cabinet floor can be removed.

In some exemplary embodiments, in order to secure retractable shelf 203 to cabinet 201, a plurality of screws 215 may be employs to simply secure the retractable shelf 202 to support members 204*a* and 205*a*. Typically, at least posterior panel 213 is secured to support members 204*a* and 205*a* by securing several screws (as shown, two on each terminal end of posterior panel 213) to a top surface of support members 204*a* and 205*a*. As will be explained in more detail with reference to other figures below, in exemplary practice of the present invention, when securing retractable shelf 202 in an extended or expanded position so as to cover or conceal floor surface 208, additional screws may be furthered used to secure anterior panel 211 to a top surface of support members 204*a* and 205*a*.

Figure 3:
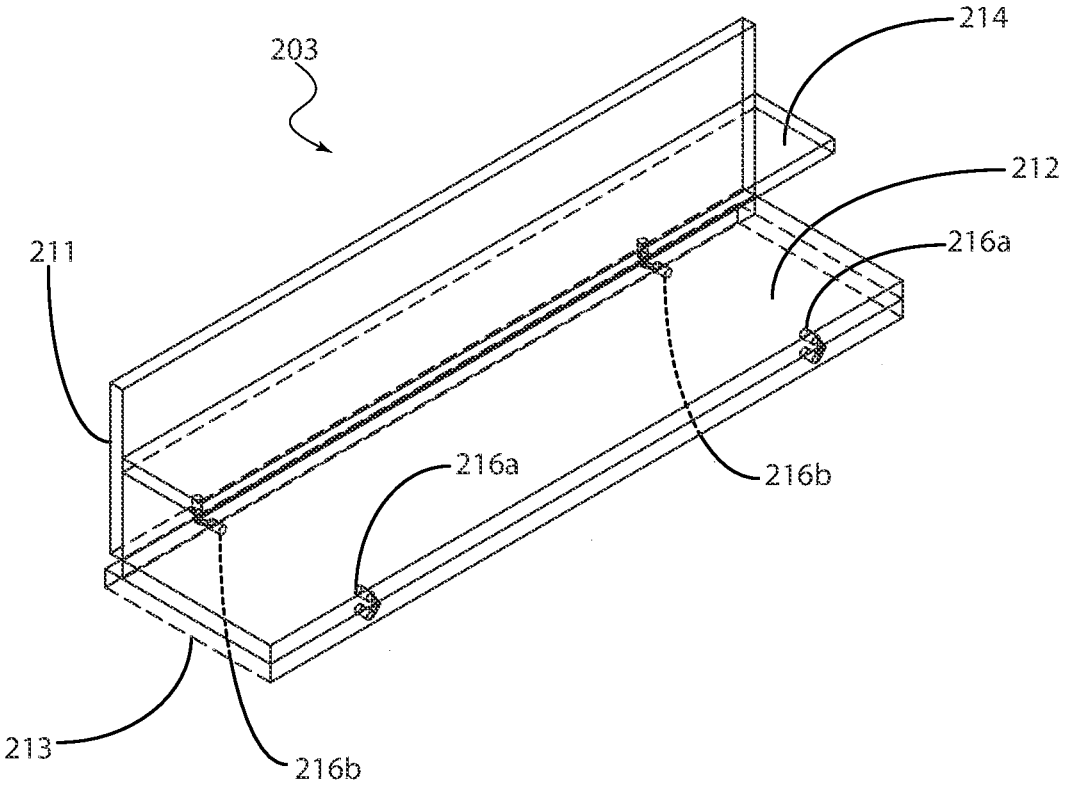
FIG. 3 illustrates a perspective view of a retractable shelf, in accordance with some exemplary embodiments of the present invention.

Now turning to the next figure, FIG. 3 illustrates a perspective view of a retractable shelf, in accordance with some exemplary embodiments of the present invention. More specifically, FIG. 3 illustrates a perspective view of a retractable shelf 202, in accordance with an exemplary embodiment of the present invention. In the shown exemplary embodiment, the retractable shelf 202 is foldable into a contracted position in which the retractable shelf 202 forms a shelf that is smaller in depth than the entire depth of the cabinet cavity. In this exemplary embodiment, the plurality of panels comprise of three panels 211, 212, and 213. When the retractable shelf 202 is in a folded position, panel 213 may serve as a support to receive panel 212 on a top surface of panel 213. Panel 211 may in turn be foldable perpendicular to both panels 213 and 212 (which are on top of one another). In some exemplary embodiments (in which panel 211, the anterior panel, includes slat 216), when the retractable shelf 202 is in a folded position, slat 216 may serve as a second shelf within the cabinet 201, that is smaller in depth than the entire floor area of cabinet 201, and smaller in depth than each of the plurality of panels 212 and 213. As may be appreciated from other views discussed below, slat 216 may be excluded altogether without deviating from the scope of the present invention.

To facilitate its retractability or the foldable configurations of the retractable shelf 202, a plurality hinges secured within each of the plurality of panels may be employed. In some embodiments, the hinging mechanism may be as simple as straps that hingely connect each adjacent pair of panels of the retractable shelf 202. In some exemplary embodiments, and as shown in FIG. 3, and also in FIG. 11A-FIG. 11C, hinges that may be secured partially internally to each of the panels 211-213 may be used. Because the hinges may pivot each panel on either direction along a longitudinal axis of each of the panels, each panel may fold onto and on top of its adjacent panel. In this way, when a posterior panel, for example panel 213, is secured within cabinet 201 (for example to support members 204*a* and 205 a of cabinet 201), hinges 216*a* which hingely couple panels 212 and 213 together, facilitate folding panel 212 on top of panel 213. Similarly, hinges 216*b* which hingely couple panels 211 and 212 together, facilitate folding panel 211 on top of panel 213, and more specifically folding panel 211 so that this anterior panel is positioned perpendicular to panels 212 and 213 (as shown in FIG. 3).

In exemplary embodiments, when the retractable shelf 202 is unfolded, the retractable shelf 202 serves as a floor for the cabinet 201, wherein the retractable shelf 202 is flat and parallel to the floor beneath the cabinet 201, and wherein the retractable shelf 202 is supported by a perpendicular slat 214 at the front edge of the cabinet 201, which slat 214 is supported by the flooring underneath the cabinet 201 when the retractable shelf 202 is in an unfolded, flattened position. In this manner, in exemplary embodiments the panels, e.g. panel 211 of the retractable shelf 202 will not touch the floor area underneath the cabinet (e.g. floor area 208 of cabinet 201), and only the perpendicular slat 214 will touch the floor.

Figure 4:
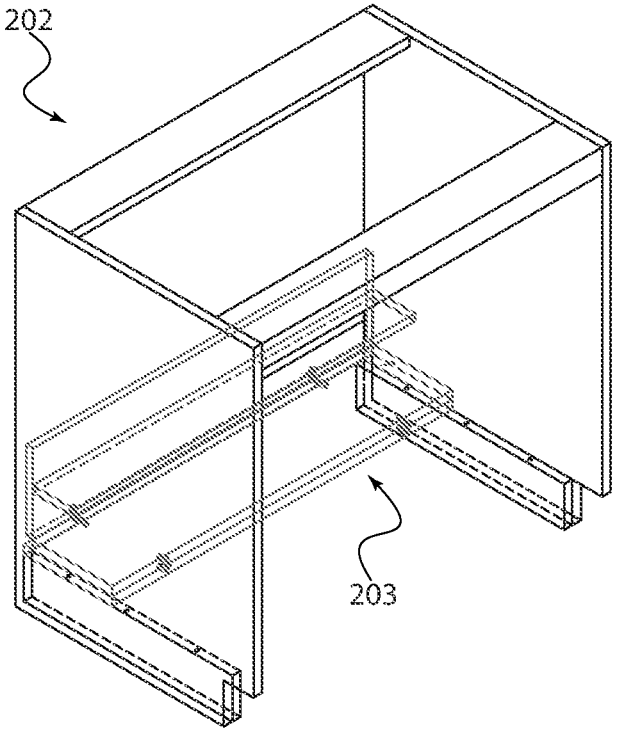
FIG. 4 illustrates a perspective view of a cabinet system including a retractable shelf within a corresponding cabinet of the system, in accordance with some exemplary embodiments of the present invention.

In some exemplary embodiments, as is the case in the embodiments illustrated in FIG. 2-FIG. 4, each of the plurality of panels 211-213 have the same width of depth. However, in some exemplary embodiments (see for example FIG. 8-FIG. 10), a posterior panel of the plurality of panels may have a greater width than an anterior panel and or an intermediary panel between the anterior and posterior panels, so that the posterior panel forms a surface with a greater depth than a surface of the anterior panel when the retractable shelf 202 is in an extended position. Similarly, in some exemplary embodiments, a slat 214 may not be employed; this may be helpful to, for example, conserve space and within cavity 209 of the cabinet 201, and conserve resources so that retrofitting a large number of cabinets in a building may be more efficient and cost effective.

An exemplary view of retractable shelf 202 in a folded or retracted position within cabinet 201 may be gleaned from FIG. 4. In exemplary embodiments, the retractable shelf 202 of the cabinet 201 can be folded into a contracted position in which the retractable shelf 202 forms a shelf that is smaller in width than the entire width of the cabinet floor, or may form a pair of shelves smaller in width than the entire width of the cabinet floor, which shelves may form at the back edge of the cabinet 201, and wherein the flooring beneath the cabinet 201 is exposed. In the shown embodiment, when the retractable shelf 202 is in a folded or retracted position, the center panel 212 will lie parallel to and touching posterior panel 213, and the anterior panel 211 will lie perpendicular to the center panel 212 and posterior panel 213; the perpendicular slat 214 will be parallel to the center panel 213 and posterior panel 213, and parallel to the floor beneath the cabinet 201. As may be also gleaned from this view, in a folded or retracted position, posterior panel 213 is secured to support members 204*a* and 205*a* inside cavity 209 of cabinet 201, while anterior panel 211 is removably detached from support members 204*a* and 205*a*.

Figure 5:
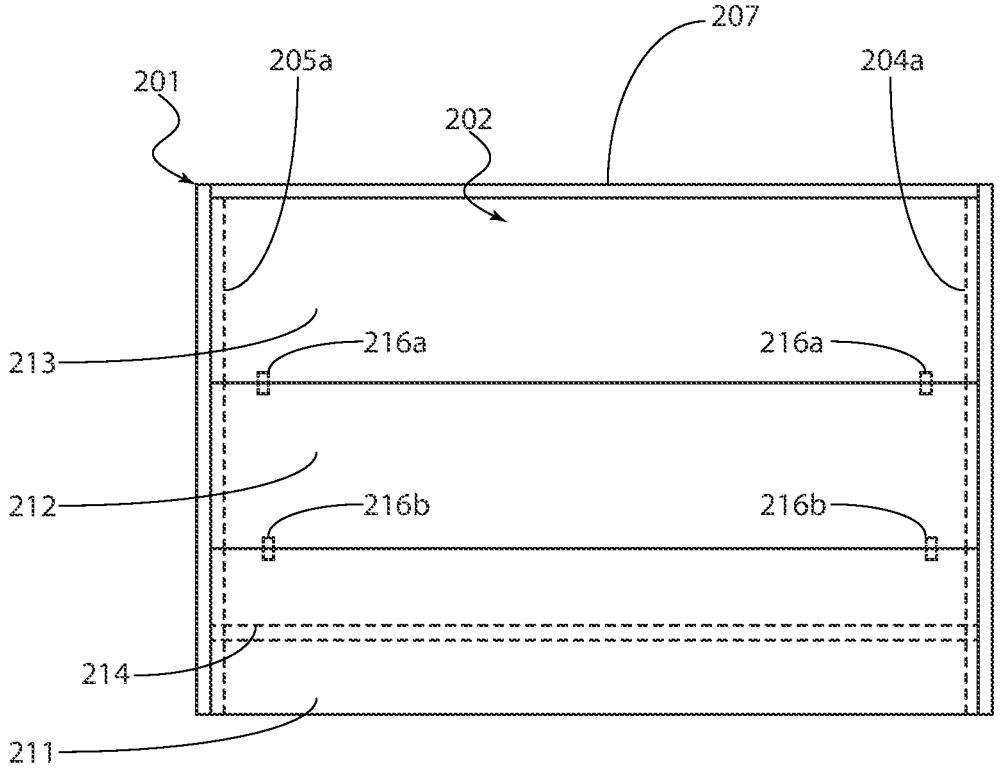
FIG. 5 illustrates a top view of a retractable shelf in an expanded configuration within a corresponding cabinet, in accordance with some exemplary embodiment of the present invention.

FIG. 5 illustrates a top view of retractable shelf 202 in an expanded configuration. More specifically, FIG. 5 depicts panels 211, 212, and 213 of retractable shelf 202 completely flat over floor surface 208 so as to provide a continuous bottom surface to the interior or cavity 209 of cabinet 201. Each of panels 211, 212, and 213 may have any dimensions desired, but the sum of the dimensions of the panels should be such that the wheelchair-accessible cabinet 201 meets ADA measurement requirements. For example, and without limiting the scope of the present invention, panel 211 may be 7 and ½ inches in width, panel 212 may also be 7 and ½ inches in width, and panel 213 may be 8 and ⅜ inches in width. From this view, it may also be appreciated that retractable shelf 202 lays over support members 204*a* and 205*a*, each panel of the retractable shelf hingely coupled to an adjacent panel with hinges 216*a* and 216*b*.

Figure 6:
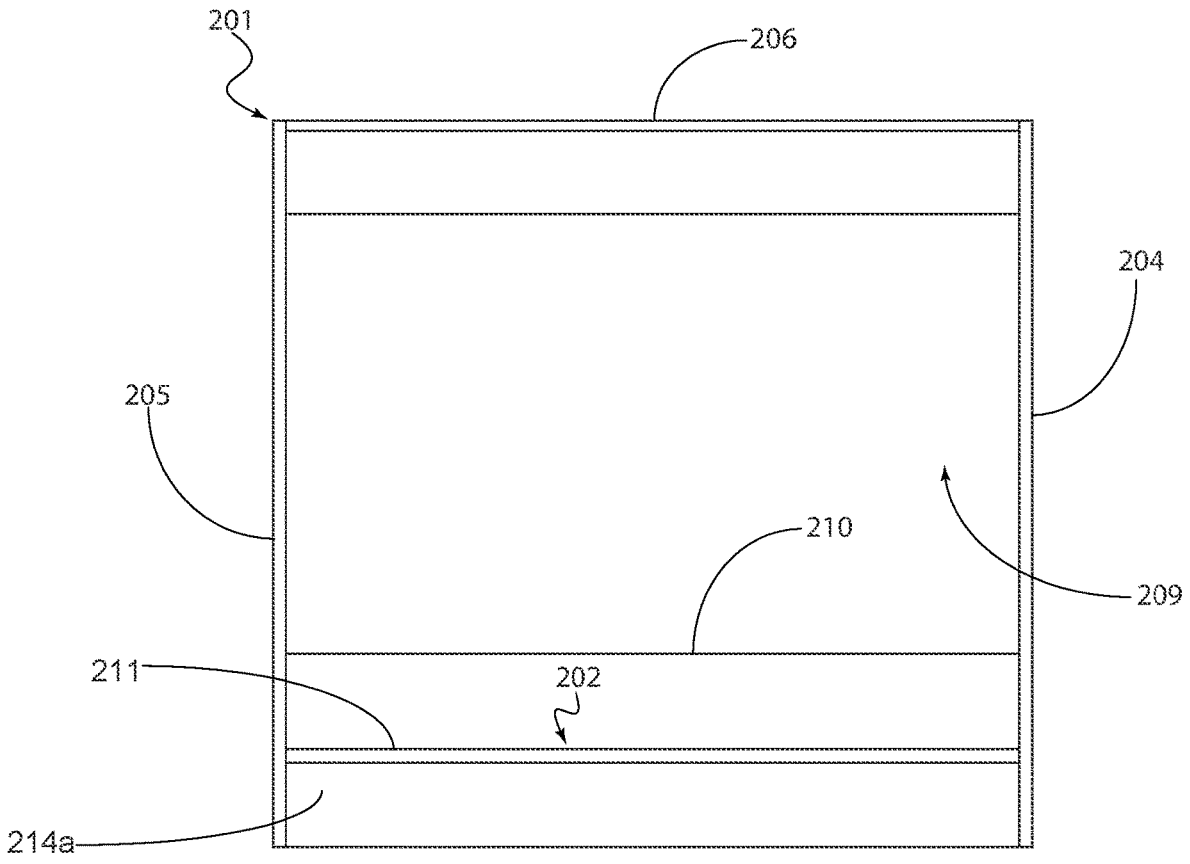
FIG. 6 illustrates a front view of an expanded retractable shelf within a corresponding cabinet, in accordance with some exemplary embodiments of the present invention.

FIG. 6 illustrates a front view of retractable shelf 202 within cabinet 201. In compliance with ADA requirements, the width of the cabinet 201 may, in exemplary embodiments, be 34 and ¾ inches, and its height may be 34 and ½ inches. The expanded retractable shelf 202 serves as a floor, i.e. bottom shelf, for the cabinet 201. The retractable shelf 202 is parallel to the underlying flooring beneath the cabinet 201. In exemplary embodiments, the retractable shelf 202 does not touch the underlying flooring beneath the cabinet 201, except where slat 214 touches the underlying flooring to support the retractable shelf 202. In exemplary embodiments, slat 214 may be attached to panel 211, by screws, bolts, or any other such coupling mechanism, such that slat 214 is perpendicular to panel 211. From the front view of FIG. 6, it may be appreciated that the anterior face 214*a* of the slat 214 forms a toe kick for cabinet 201 when retractable shelf 202 is in the extended position.

Figure 7:
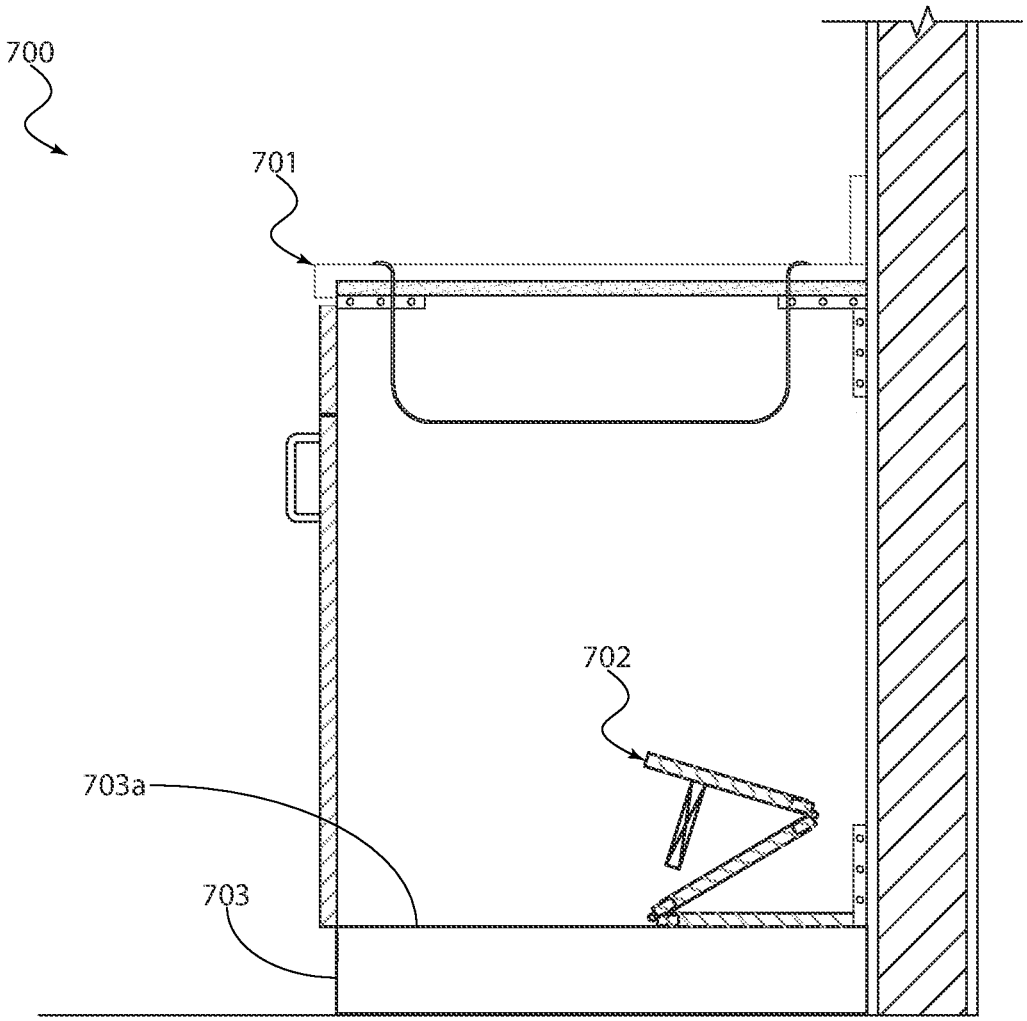
FIG. 7 illustrates a side cross-sectional view of a retractable shelf within a cabinet being folded or retracted to reveal a wheelchair accessible space within a portion of the cabinet, in accordance with some exemplary embodiments of the present invention.

Now turning to the next figure, FIG. 7 illustrates a side cross-sectional view of a retractable shelf within a cabinet being folded or retracted to reveal a wheelchair accessible space within a portion of the cabinet, in accordance with some exemplary embodiments of the present invention. More specifically, FIG. 7 illustrates a side perspective view of system 700, comprising cabinet 701, which has been retrofitted with retractable shelf 702. Within cabinet 201 may be an under-mount sink; when the retractable shelf 702 is folded or otherwise retracted, the sink will then meet ADA requirements, such that a wheelchair can slide comfortably into cabinet 201 under sink, thereby allowing for wheelchair access to the sink. As shown in this view, retractable shelf 702 is partially folded within cabinet 701.

In exemplary embodiments, the cabinet 701 housing the retractable shelf 701 meets ADA measurement requirements, wherein the height of the cabinet 701 may be a minimum of 27 inches, the width of the cabinet 701 may be a minimum of 30 inches, and wherein the length of the cabinet 701 may be a minimum of 23 and ⅜ inches. In exemplary embodiments, the length of the cabinet 701 may be 25 and ½ inches, each of the anterior and intermediate panels of the retractable shelf 702 may be 7 and ½ inches, and or the posterior panel may be 8 and ⅜ inches, and the height of the cabinet 701 may be 36 inches. Of course, other measurements and dimensions may be possible without deviating from the scope of the present invention.

Figure 8:
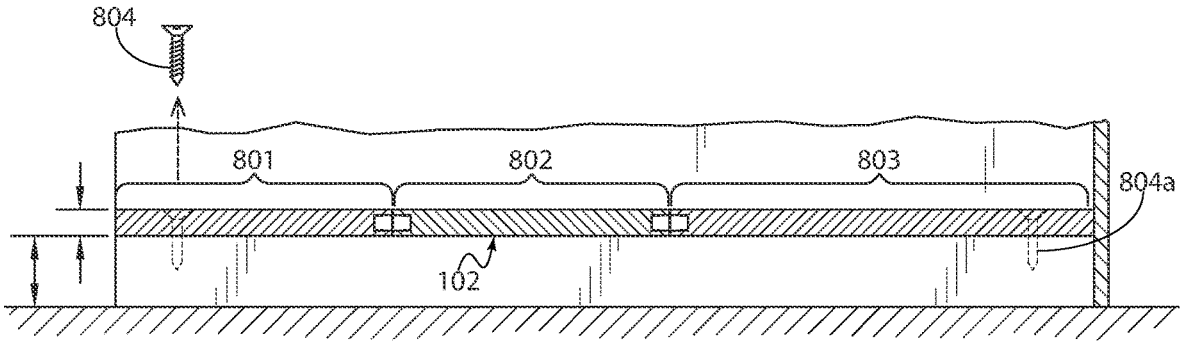
FIG. 8-FIG. 10 illustrate sequential cross-sectional views depicting a retractable shelf within a cabinet being folded or retracted to reveal a wheelchair accessible space within a portion of the cabinet, in accordance with some exemplary embodiments of the present invention.
Figure 9:
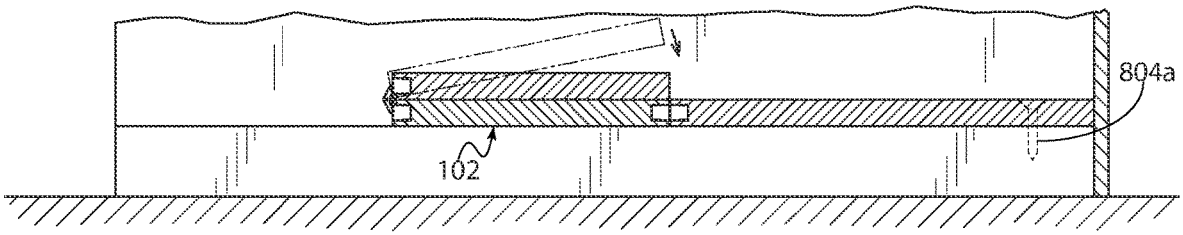
Figure 10:
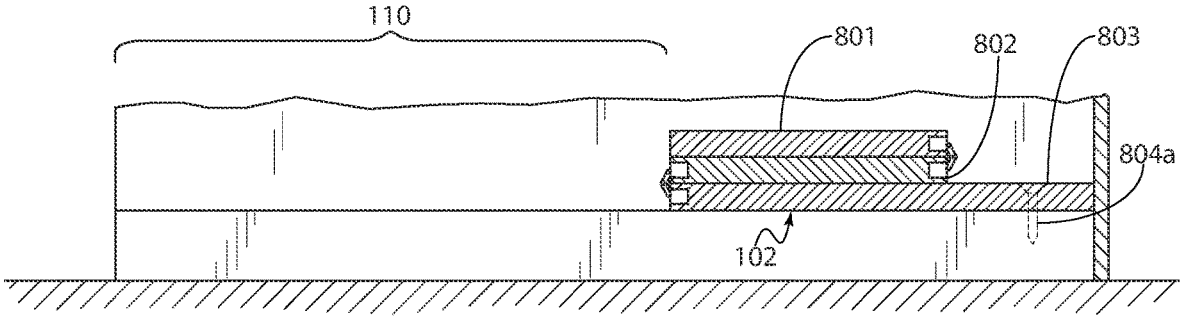

Turning now to the next set of figures, FIG. 8-FIG. 10 illustrate sequential cross-sectional views depicting a retractable shelf within a cabinet being folded or retracted to reveal a wheelchair accessible space within a portion of the cabinet, in accordance with some exemplary embodiments of the present invention. More specifically, FIG. 8-FIG. 10 depict a sequence of cross-sectional views along line segment A-A as shown in FIG. 1A, illustrating a folding sequence of retractable shelf 102.

In FIG. 8, an initial step, whereby a retractable shelf 102 is in an expanded position, may include removing a coupling component such as a screw 804 that may be used to secure the retractable shelf 102 to a portion of the cabinet (such as a support component or the like). As may be appreciated from this view, retractable shelf 102 comprises three panels 801-803, whereby panel 801 is an anterior panel secured to a support component of the cabinet with a support mechanism such as a screw, tac, nail, or the like—in the shown embodiment, a screw 804 is used. Notably, in this embodiment, posterior panel 803 is also secured to the support component of the cabinet with a similar screw 804*a*. That screw is left intact as the posterior panel 803 should remain secured to the cabinet prior to and throughout the folding sequence.

In FIG. 9, following removal of screw 804, the anterior panel 801 may be lifted and folded back towards the posterior of the cavity within the cabinet. In exemplary embodiments of the present invention, the hinged connection between the anterior panel 801 and the intermediate panel 802 should be configured to allow the anterior panel 801 to be folded in a manner such that the anterior panel 801 can lay parallel and on top of the intermediate panel 802. In some exemplary embodiments, it may be desirable to leave the retractable shelf at this position. In some exemplary embodiments however, this may not be enough to reveal an appropriate wheelchair accessible space and thus the retractable shelf 102 may be further folded or retracted.

For example, following the folding of the anterior panel 801 onto the intermediate panel 802, anterior panel 801 may be lifted and intermediate panel 802 may instead be flipped onto a top surface of posterior panel 803. In exemplary embodiments of the present invention, the hinged connection between the intermediate panel 802 and the posterior panel 803 should be configured to allow the intermediate panel 802 to be folded in a manner such that the intermediate panel 802 can lay parallel and on top of the posterior panel 803, as shown in FIG. 10.

Also in FIG. 10, following the step above, the anterior panel 801 may be folded over the intermediate panel 802 in a manner such that each panel is parallel and laying on top of the preceding panel—for example, as shown, anterior panel 801 lays on top of intermediate panel 802, which in turn lays on top of posterior panel 803. In this manner, the retractable shelf 102 is folded or retracted so that each panel (i.e. at least the anterior and intermediate panels) is stacked on top of an adjacent panel thereby revealing a wheelchair accessible area 110. This foldable sequence (and system of the present disclosure) is particularly helpful in tenant building where there are large numbers of cabinets that may require making accessible to those tenants with needs. The typical installation protocol that requires removal of a bottom shelf in order to make room for a wheelchair accessible space within a portion of the cabinet can be time consuming and expensive by way of labor spent on each removal and or changing in configuration. With the present invention, the retractable shelf may be universally installed so as to facilitate conversion into a wheelchair accessible cabinet when the need arises, without requiring a complete de-installation and or re-installation of a cabinet system that meets the accessibility requirements.

Figure 11A:
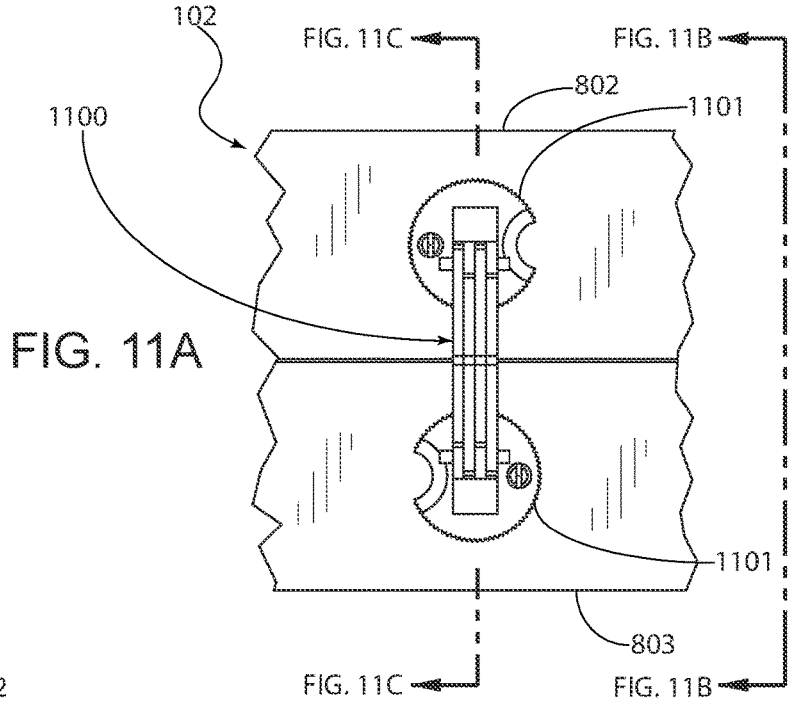
FIG. 11A illustrates a front close-up view of an exemplary hinge used to couple a plurality of panels that make up a retractable shelf in accordance with some exemplary embodiments of the present invention, a front view of an expanded retractable shelf within a corresponding cabinet, in accordance with some exemplary embodiments of the present invention.
Figure 11B:
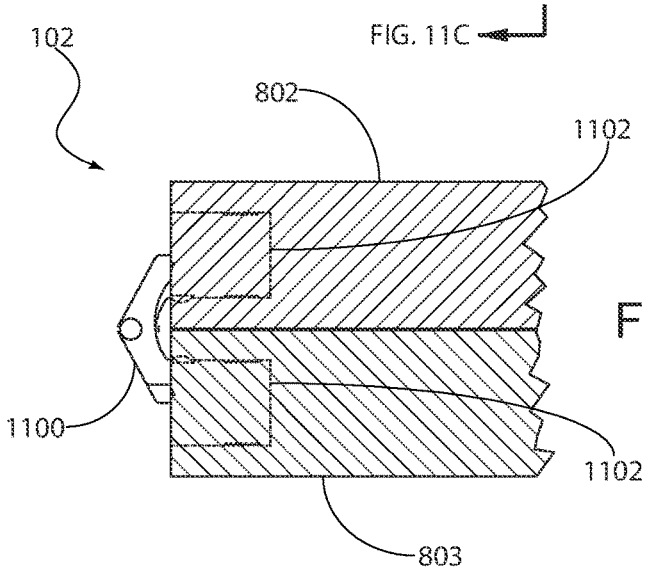
FIG. 11B-FIG. 11C illustrate cross-sectional views of an exemplary hinge used to couple a plurality of panels that make up a retractable shelf in accordance with some exemplary embodiments of the present invention.
Figure 11C:
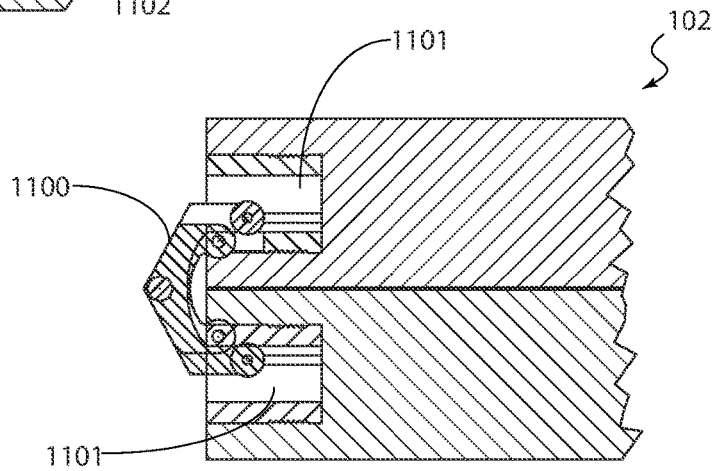

Turning to the next set of figures, FIG. 11A illustrates a front close-up view of an exemplary hinge used to couple a plurality of panels that make up a retractable shelf in accordance with some exemplary embodiments of the present invention; FIG. 11B-FIG. 11C illustrate cross-sectional views thereof. From these view, it may be appreciated that in some exemplary embodiments, a plurality of hinges such as hinge 1100 may comprise hidden barrel hinges that may be partially inserted into adjacent panels, and which allow each of the adjacent panels to pivot in either direction—for example making each panel foldable in an upward manner relative to the floor above which they reside, or foldable in a downward manner relative to the floor above which they reside. In the depicted exemplary embodiment, a portion of panels 802 and 803 are shown. Hinge 1100 can be seen comprising two barrel like components 1101, which a person of ordinary skill in the art will appreciate are configured to be inserted into apertures 1102 drilled into panels 802 and 803. Because the body connecting components 1101 is designed to pivot about an axis of a hinge support 1103, this type of hinge is suitable for panels 802 and 803 to be folded in opposite directions. Of course, as mentioned above, other hinges and hinge devices that enable this foldability may be employed without deviating from the scope of the present invention.

Figure 12A:
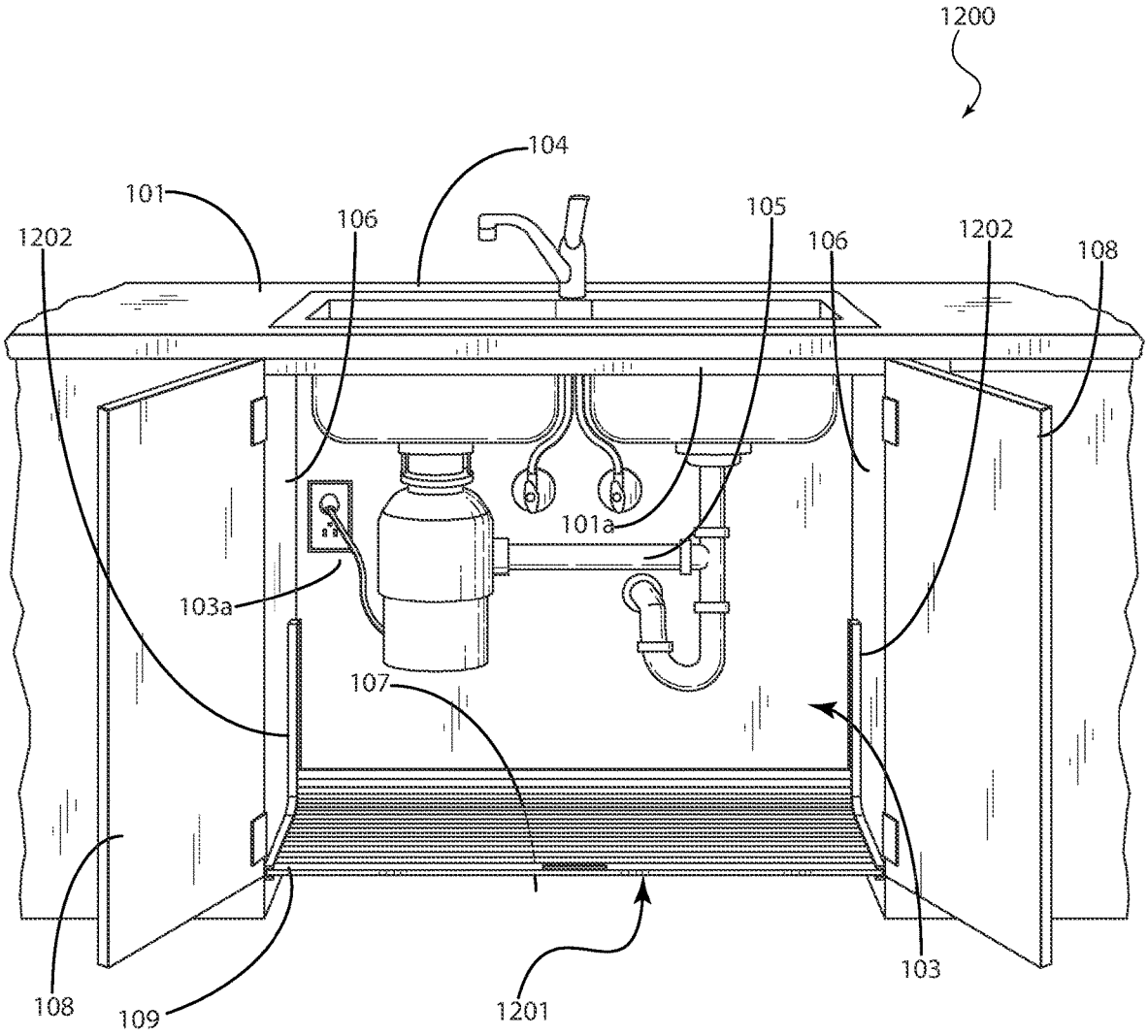
FIG. 12A illustrates a cabinet system configured with a retractable shelf for accommodating wheelchair accessibility, in accordance with an exemplary embodiment of the present invention, the system shown in an expanded position for concealing a wheelchair accessible space.

Now turning to the last set of figures, FIG. 12A illustrates a cabinet system configured with a retractable shelf for accommodating wheelchair accessibility, in accordance with an exemplary embodiment of the present invention, in which the retractable shelf is adapted to slide or roll away instead of folding. More specifically, cabinet system 1200 is shown including cabinet 101 with a retractable shelf 1201 that is configured to retract and expand in order to, respectively, reveal and conceal a wheelchair accessible space within a portion of a cavity 103 of cabinet 101. In this view of FIG. 12A, retractable shelf 1201 is in an expanded configuration.

As may be appreciated from this view, when in the expanded configuration, retractable shelf 1201 completely covers or conceals the surface area 107 within cavity 103. When selectively exposed, surface area 107 or a portion thereof, may be utilized as a wheelchair accessible space. As such, wheelchair accessible space 110 becomes accessible when the retractable shelf 1201 is retracted as shown in the next figure. In this exemplary embodiment, the retractable shelf 1201 retracts by sliding backwards or towards a posterior panel of cabinet 101. To these ends, in some exemplary embodiments, retractable shelf 1201 may be installed to register within two tracks 1202 on opposite cabinet walls so that the retractable shelf 1201 may be moved along a length of said tracks 1202.

Figure 12B:
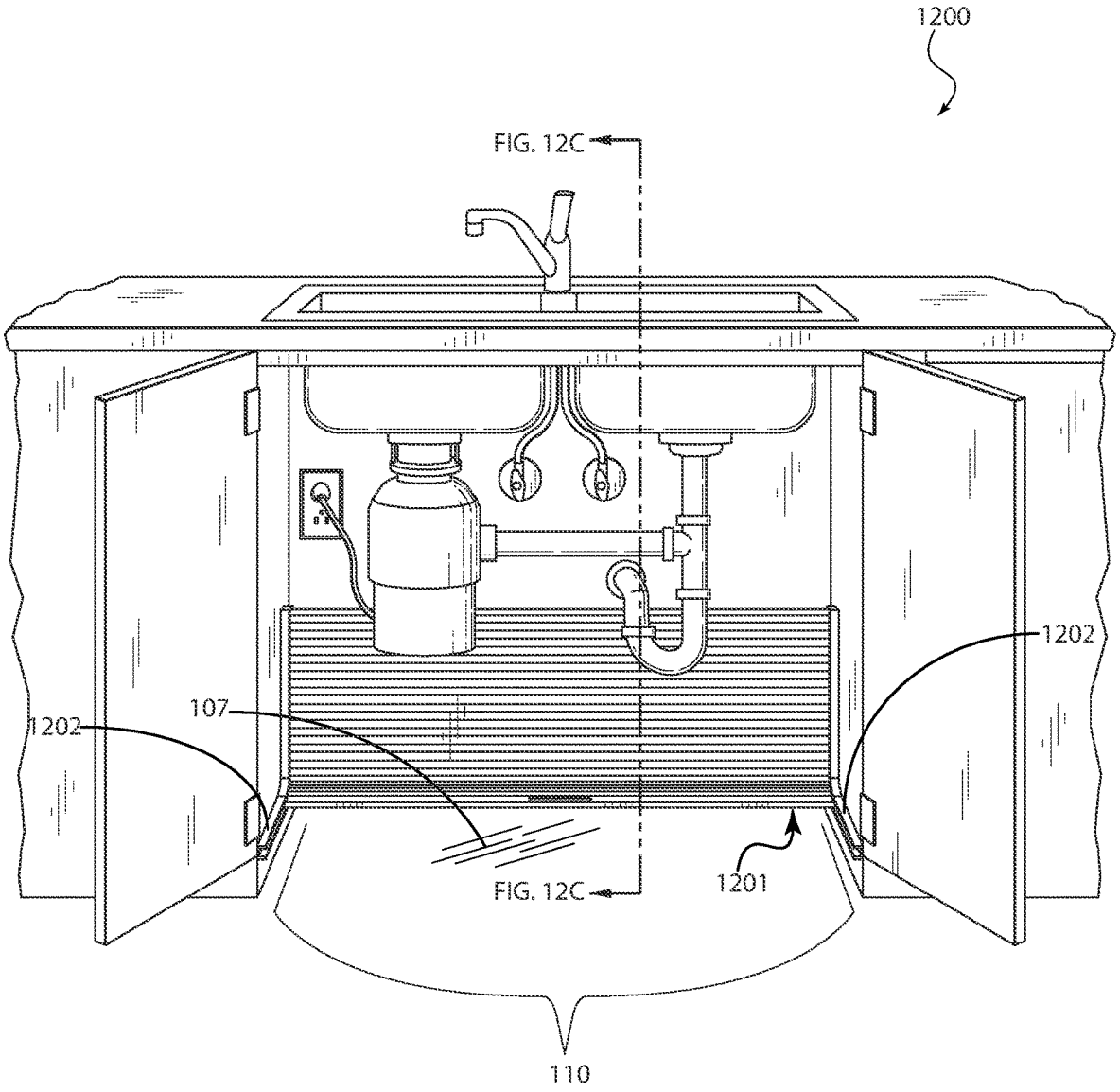
FIG. 12B illustrates a cabinet system configured with a retractable shelf for accommodating wheelchair accessibility, in accordance with an exemplary embodiment of the present invention, the system shown in a retracted position for revealing a wheelchair accessible space.

FIG. 12B illustrates cabinet system 1200 in a retracted position for revealing wheelchair accessible space 110. From this view, it may be appreciated that in some exemplary embodiments, the retractable shelf 1201 may be slid back so that it is at least partially positioned along a height of a back or posterior panel 103*a* of cabinet 101. Other means may achieve a similar goal of sliding or retracting retractable shelf 1201 out of the way to reveal wheelchair accessible space 110; for example, and without limiting the scope of the present invention, retractable shelf 1201 may be configured to slide backwards so that it is rolled within a confined space.

Figure 12C:
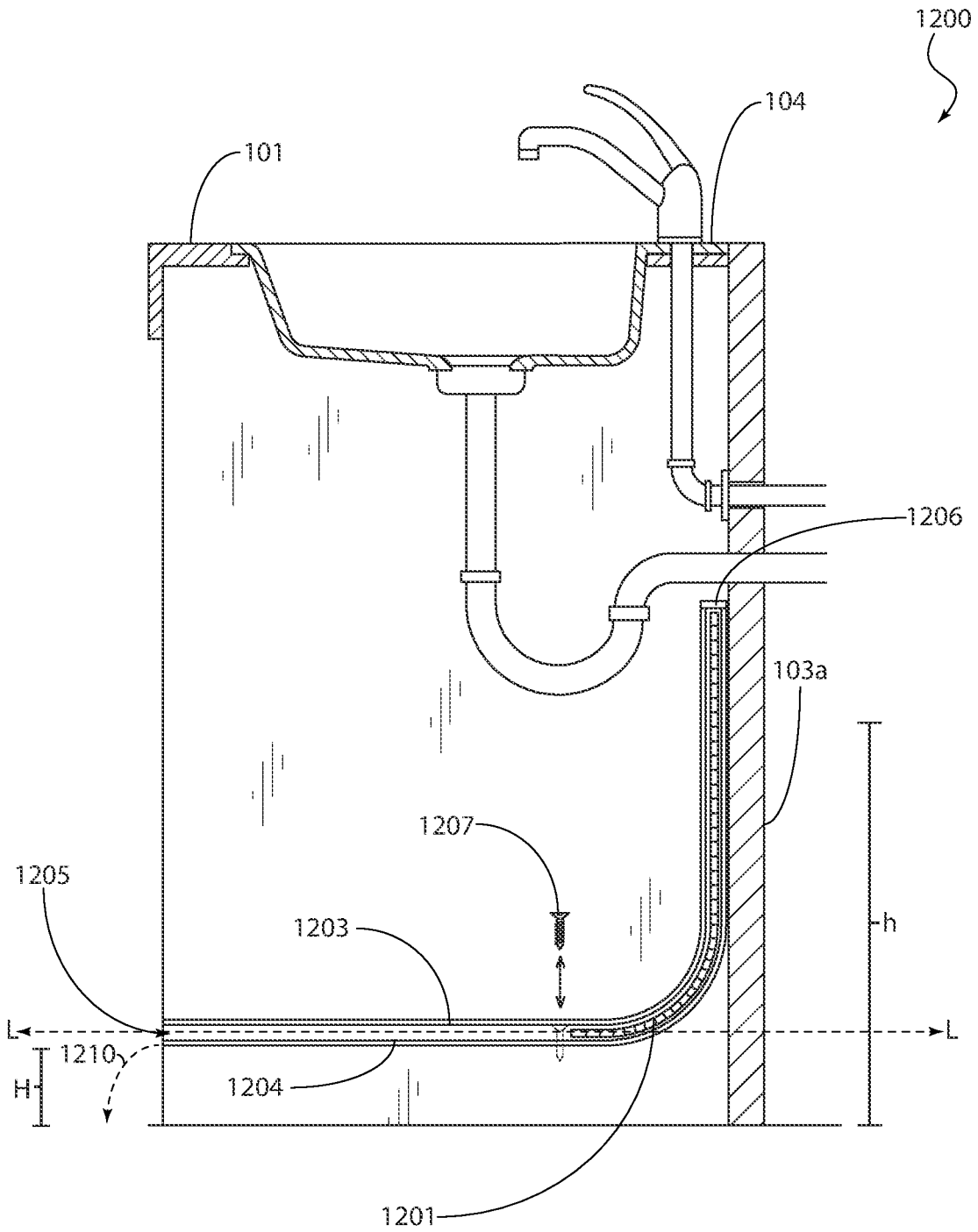
FIG. 12C-FIG. 12F illustrate a side cross-sectional view of several embodiments of a retractable shelf within a cabinet being slid away or retracted to reveal a wheelchair accessible space within a portion of the cabinet, in accordance with some exemplary embodiments of the present invention.

FIG. 12C illustrates a side cross-sectional view of retractable shelf 1201 within cabinet 101 being slid away or retracted to reveal a wheelchair accessible space within cavity 103 of cabinet 101, in accordance with some exemplary embodiments of the present invention. From this view, it may be appreciated that in exemplary embodiments tracks 1202 typically comprise a top surface 1203 and a bottom surface 1204, which form a channel 1205 adapted to receive a portion of retractable shelf 1201. In this exemplary embodiment, because retractable shelf 1201 is required to be bendable to some extent, retractable shelf 1201 may be constructed as multiple small panels that are configured to pivot along a length of each panel. In exemplary embodiments, a mechanism may be used to secure retractable shelf 1201 in a retracted position such as a magnetic component situated at a terminal end 1206 of the channel 1205 or tracks 1202. Alternatively, or even optionally or additionally, retractable shelf 1201 may be secured in a retracted position by way of a screw 1207 that, as explained above with reference to other embodiments, may be removed or placed depending on the desired position of the retractable shelf 1201.

In some exemplary embodiments, a portion of each track 1202 runs along a length of each side wall of cabinet 101 at a height H that is in close proximity to the floor or surface area 107. For example, in exemplary embodiments, when in an expanded position, retractable shelf 1201 is situated at height H that is in closer proximity to surface area 107 than it is to a middle region of cavity 103 or height h. Moreover, a length towards a posterior end of track 1202 generally curves upwards so that track 1202 runs along height h. In this way, track 1202 enables retractable shelf 1201 to be slid away or retracted to reveal the wheelchair accessible space. In such exemplary embodiments, a cross-section of each tracks 1202 of retractable shelf 1201 form an L-shape with the bend of the L-shape having a curvature between the horizontal length of each track 1202 and the vertical length of each track 1202.

Figure 12D:
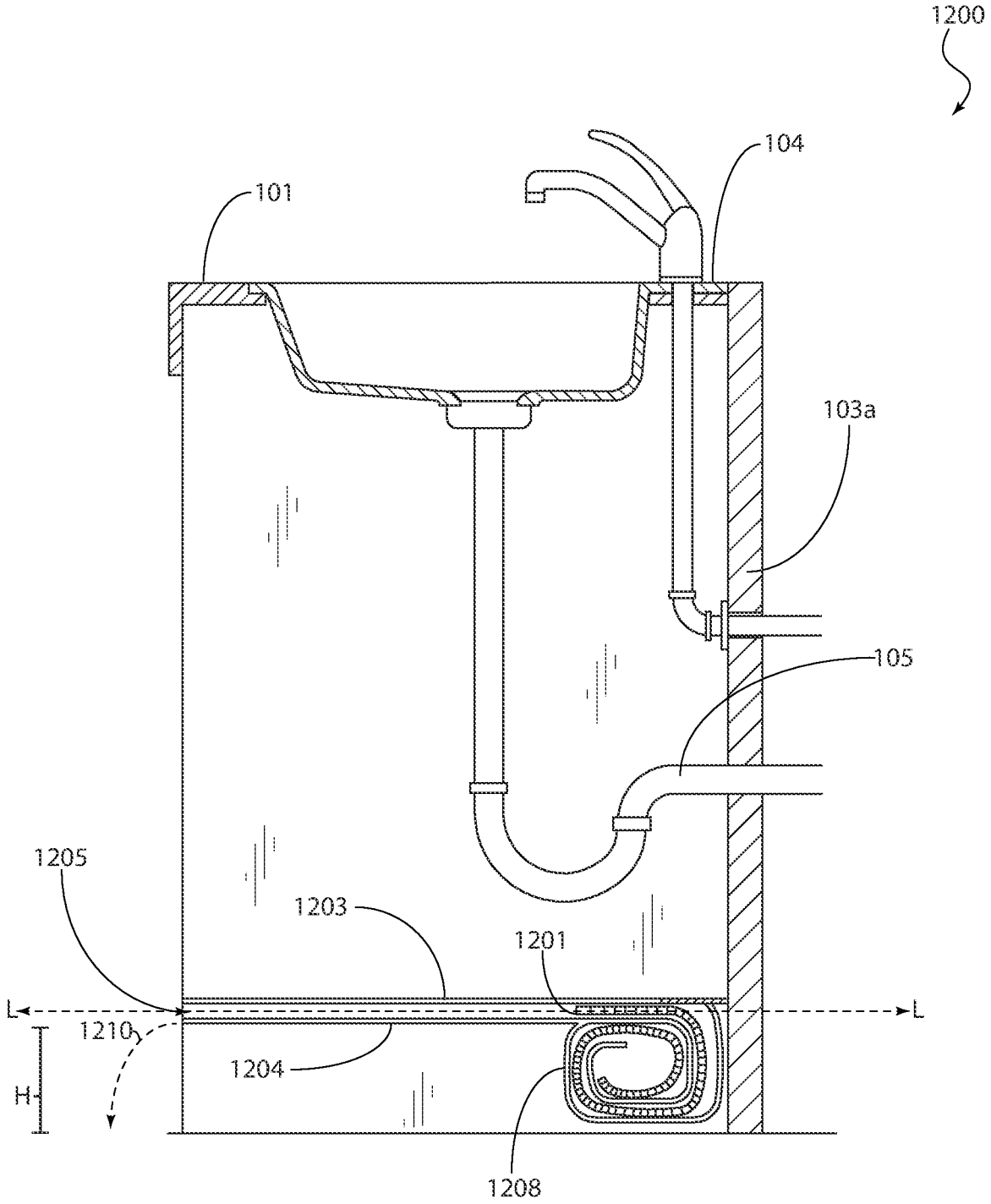
Figure 12E:
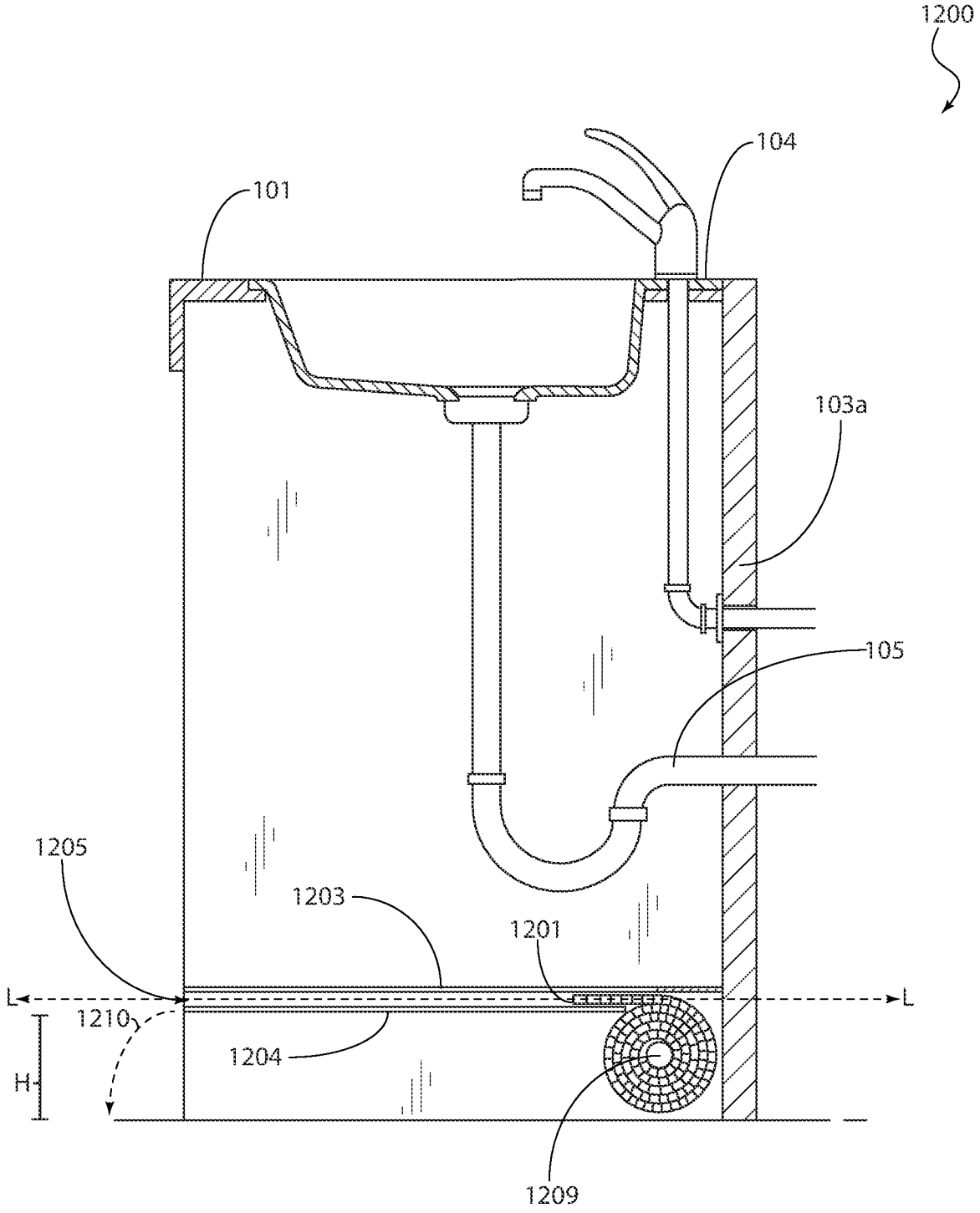

In yet other exemplary embodiments, retractable shelf 1201 folds and or tucks into itself in order to avoid interfering with plumbing components 105. For example, and without limiting the scope of the present invention, FIG. 12D and FIG. 12E illustrates other embodiments of retractable shelf 1201. From the side cross-sectional view of FIG. 12D it may be appreciated that in some embodiments, retractable shelf 1201 may be configured to retract below channel 1205 and or fold below the plane on which retractable shelf 1201 may be expanded across (i.e. a plane along a length of channel 105), rather than curving upwardly and vertically up against the posterior cabinet wall 103 of cabinet 101. In this embodiment, channel 1205 may, instead of curving vertically along posterior wall 103*a*, curve downwardly and into a retaining section 1208 in which at least a portion of retractable shelf 1201 may be tucked into. In this way, retractable shelf 1201 may be slid away or retracted to reveal a wheelchair accessible space within cavity 103 of cabinet 101.

In yet another embodiment, such as the embodiment depicted in FIG. 12E, retractable shelf 1201 may be configured to be rolled up beneath channel 1205. This may be achieved by coupling retractable shelf 1201 to a rotating structure 1209 that enables retractable shelf 1201 to be retracted into a roll like structure. Embodiments such as those depicted in FIG. 12D and FIG. 12E may be desirable in situations in which plumbing components 105 may be an obstacle to or get in the way of an upward track or channel 1205 such as the embodiment depicted in FIG. 12C. Moreover, having retractable shelf 1201 slide below or downwardly may ultimately conserve space within cabinet 101 or more specifically within cavity 103 of cabinet 101, so as to maximize the use of cavity 103.

Figure 12F:
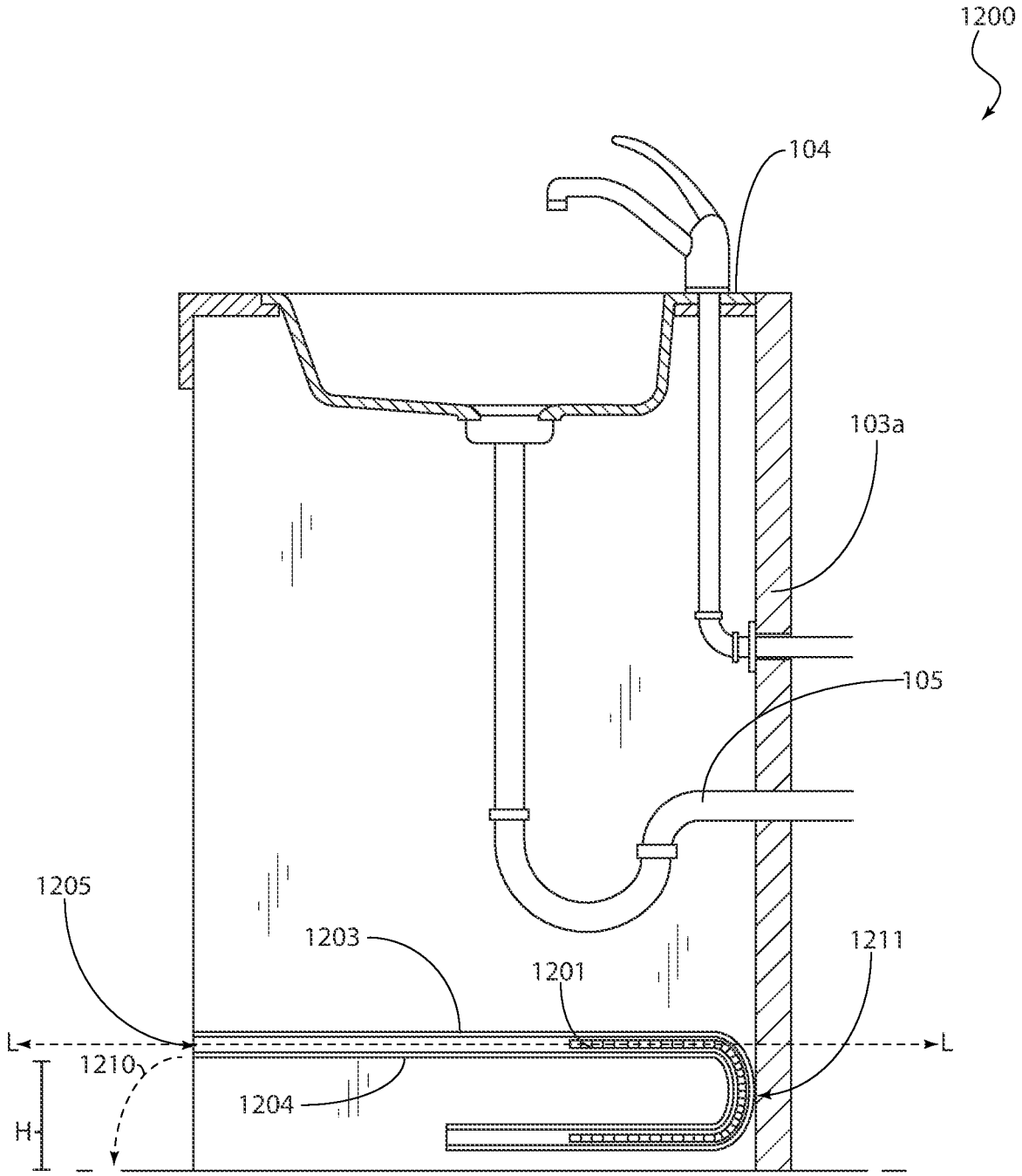

FIG. 12F depicts yet another exemplary embodiment, in which retractable shelf 1201 may be configured to be slid beneath channel 1205, wherein channel 1205 includes a curvature, such as a U-shaped curved cross-section 1211, whereby a first length of channel 1205 runs along length L, and a second length or portion of channel 1205 runs below and parallel to the first portion along length L. This is another embodiment that avoids structures above retractable shelf 1201 so as to avoid obstructing or minimizing space that may be required for plumbing components 105.

In these embodiments, retractable shelf 1201 is configured to retract or tuck below height H or below the plane on which retractable shelf 1201 expands or moves across (i.e. along a length L of channel 1205). Moreover, on either embodiments of FIG. 12A-FIG. 12E, it may be appreciated that because retractable shelf is configured to slide on tracks and fold or bend by way of a plurality of panels, retractable shelf 1201 may be configured for pulling out along pathway 1210 in a manner such that a small anterior portion of the retractable shelf 1201 may function as a tow kick.

This invention makes the floor, i.e. bottom shelf, of a cabinet adjustable so that the flooring beneath the cabinet can be accessed, in order to finish the surface of the flooring, or for other such purposes. More importantly, this invention easily converts a typical cabinet into a wheelchair-accessible cabinet, without first having to remove and/or disassemble the cabinet or any portion thereof. In other words, this invention simplifies the process of converting a traditional sink cabinet to a wheelchair-accessible sink cabinet, and vice-versa.

A system and method for retrofitting cabinets with a retractable shelf to accommodate accessibility guidelines has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A method for converting a cabinet into a wheelchair accessible space, the method comprising:

providing a cabinet with a retractable shelf comprising a plurality of panels including an anterior panel, an intermediate panel, and a posterior panel;

removing a coupling component securing the anterior panel of the retractable shelf to a support component of the cabinet;

lifting and folding the anterior panel towards the posterior of a cabinet cavity;

folding the intermediate panel onto a top surface of the posterior panel within the cabinet;

stacking the anterior panel on top of the intermediate panel; and revealing a wheelchair accessible area within the cabinet by the stacking of the panels.

2. The method of claim 1, wherein the retractable shelf is initially in an expanded position.

3. The method of claim 1, wherein the coupling component comprises a screw.

4. The method of claim 1, wherein the anterior panel is hingedly connected to the intermediate panel.

5. The method of claim 1, wherein the intermediate panel is hingedly connected to the posterior panel.

6. The method of claim 1, wherein the folding of the anterior panel onto the intermediate panel is such that the anterior panel lays parallel and on top of the intermediate panel.

7. The method of claim 1, wherein the folding of the intermediate panel onto the posterior panel is such that the intermediate panel lays parallel and on top of the posterior panel.

8. The method of claim 1, wherein the retractable shelf is configured to be universally installed within the cabinet.

9. The method of claim 1, wherein the method does not require a complete de-installation and re-installation of the cabinet to meet accessibility requirements.

10. The method of claim 1, wherein the method facilitates conversion of the cabinet into a wheelchair accessible space without extensive labor.

11. A method for manipulating a retractable shelf within a cabinet to create a wheelchair accessible space, the method comprising:

providing a cabinet with a retractable shelf comprising three hingedly connected panels including an anterior panel, an intermediate panel, and a posterior panel;

detaching the anterior panel from a support component of the cabinet by removing a screw;

folding the anterior panel towards the posterior of a cabinet cavity and laying it parallel on top of an intermediate panel;

lifting the anterior panel and flipping the intermediate panel onto a top surface of a posterior panel;

folding the anterior panel over the intermediate panel to form a compact stack;

revealing a wheelchair accessible space by the compact stacking of the panels; and maintaining the posterior panel secured to the cabinet throughout the method.

12. The method of claim 11, wherein the retractable shelf is initially in an expanded position prior to manipulation.

13. The method of claim 11, wherein the hinged connection between the anterior and intermediate panels is configured to allow parallel folding.

14. The method of claim 11, wherein the hinged connection between the intermediate and posterior panels is configured to allow parallel folding.

15. The method of claim 11, wherein the retractable shelf is adapted to remain in a partially folded position to reveal an appropriate wheelchair accessible space.

16. The method of claim 11, wherein the retractable shelf is further folded or retracted to reveal the wheelchair accessible space when the partially folded position is insufficient.

17. The method of claim 11, wherein the retractable shelf comprises hidden barrel hinges for folding the panels.

18. The method of claim 11, wherein the hidden barrel hinges are partially inserted into apertures drilled into the panels.

19. The method of claim 11, wherein the hidden barrel hinges comprise two barrel-like components configured to pivot about an axis.

20. The method of claim 11, wherein the retractable shelf is configured to be manipulated without the need for labor-intensive removal or alteration of the cabinet structure.

* * * * *